US009969062B2

(12) United States Patent
Huang

(10) Patent No.: US 9,969,062 B2
(45) Date of Patent: May 15, 2018

(54) WRENCH FOR OPERATING OBJECTS OF DIFFERENT SIZES

(71) Applicant: Yu-Shiang Huang, Taichung (TW)

(72) Inventor: Yu-Shiang Huang, Taichung (TW)

( * ) Notice: Subject to any disclaimer, the term of this patent is extended or adjusted under 35 U.S.C. 154(b) by 97 days.

(21) Appl. No.: 15/152,493

(22) Filed: May 11, 2016

(65) Prior Publication Data

US 2017/0106504 A1 Apr. 20, 2017

(30) Foreign Application Priority Data

Oct. 20, 2015 (TW) ..... 104134342 A

(51) Int. Cl.
*B25B 13/28* (2006.01)
*B25B 13/52* (2006.01)

(52) U.S. Cl.
CPC ..... *B25B 13/28* (2013.01); *B25B 13/52* (2013.01)

(58) Field of Classification Search
CPC ..... B25B 13/02; B25B 13/48; B25B 13/52; B25B 7/04; B25B 13/28
See application file for complete search history.

(56) References Cited

U.S. PATENT DOCUMENTS 2,742,808 A * 4/1956 Haberle ..... B25B 13/28 403/146
5,247,715 A * 9/1993 Nishiguchi ..... B25B 13/00 7/138
6,026,714 A * 2/2000 Chang ..... B25B 7/02 81/100
6,349,621 B1 * 2/2002 Khachatoorain ..... B25B 13/28 81/111

FOREIGN PATENT DOCUMENTS

GB 191516173 A * 10/1916 ..... B25B 7/02
GB 227271 A * 1/1925 ..... B25B 13/28

* cited by examiner

*Primary Examiner* — Christopher M Koehler
*Assistant Examiner* — Joel Crandall

(57) ABSTRACT

A wrench includes a first part, a second part and a third part. The first part has a first toothed portion and a first pivotal portion. The second part has a third pivotal portion which is connected to the first pivotal portion so that the second part is pivoted an angle relative to the first part about the first pivotal portion. The third part is movably connected to the second part and has a second toothed portion which faces the first toothed portion so that objects of different sizes are clamped between the first and second toothed portions.

7 Claims, 8 Drawing Sheets

WRENCH FOR OPERATING OBJECTS OF DIFFERENT SIZES

BACKGROUND OF THE INVENTION

1. Fields of the Invention

The present invention relates to a wrench, and more particularly, to a wrench suitable for operating objects of different sizes.

2. Descriptions of Related Art

U.S. Pat. No. 4,967,612 discloses a flare nut wrench and comprises a resilient socket having an internal surface defining an area for receiving a flare nut. The internal surface is used for gripping engagement with the external surface of a flare nut. The socket has an outer socket face and has a gap therein through which a tube secured by the flare nut passes prior to engaging the socket with the flare nut. A base has an axial line extending therethrough, and a socket pivot on the base is positioned on one side of the axial line for pivoting the socket with respect to the base. A prong projects from the base on the other side of the axial line at a location spaced laterally of the socket pivot. The prong has a prong surface extending in the general direction of the axial line for engagement with the outer face of the socket. The gap extends totally between the prong and the socket pivot when the outer socket face is engaged by said prong. The gap extends for a selected circumferential distance such that it remains open upon engagement of the socket with the flare nut and prong. A handle means is associated with the base for applying torque to the wrench to rotate the flare nut. The handle means urges the prong surface against the outer face of the socket to squeeze the socket against the external surface of the flare nut so as to prevent the gap from opening and to thereby prevent the wrench from rounding off the flare nut.

However, the socket has to contact the consecutive sides of the object to rotate the object, and after the wrench is rotated an angle, the socket has to be disengaged from the object and re-mount to the object at another angle, this prolongs operation time. Besides, only one side of the object can be rotated by the wrench.

U.S. Pat. No. 6,978,701 discloses a wrench having a head portion adapted to engage and apply torque to a workpiece, and turning means for turning the head portion. The wrench further comprises a flexible ring portion included in the head portion and attached to the turning means at one end and free at its other end. The ring portion has an inner working surface for engaging the workpiece. A clamping means is included in the turning means for clamping the free end of the ring portion against the workpiece when the turning means is turned in a predetermined direction. A portion of the flexible ring portion at or adjacent the free end thereof has an external, first cam surface which defines a wedge shape with the inner working surface of the portion. The wedge shape increases in thickness towards the free end of the flexible ring portion. The clamping means has a second cam surface arranged to cooperate with said wedge-shaped portion so that when torque is applied to the head portion in the predetermined direction, the wedge-shaped portion is urged in such a peripheral direction relative to the workpiece as to tend to close the flexible ring portion around the workpiece.

The wrench can only rotate a fixed sized workpiece and the structure require multiple steps of welding processes and which increase the manufacturing cost. When operating, the pivotal paths are difficult to be controlled due to the complicated pivoting connections.

The present invention intends to provide a wrench which is designed to improve the shortcomings mentioned above.

SUMMARY OF THE INVENTION

The present invention relates to a wrench which comprises a first part, a second part and a third part. The first part has a first toothed portion and a first pivotal portion. The second part has a third pivotal portion which is connected to the first pivotal portion so that the second part is pivoted an angle relative to the first part about the first pivotal portion. The third part is movably connected to the second part and has a second toothed portion which faces the first toothed portion so that objects of different sizes are clamped between the first and second toothed portions.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
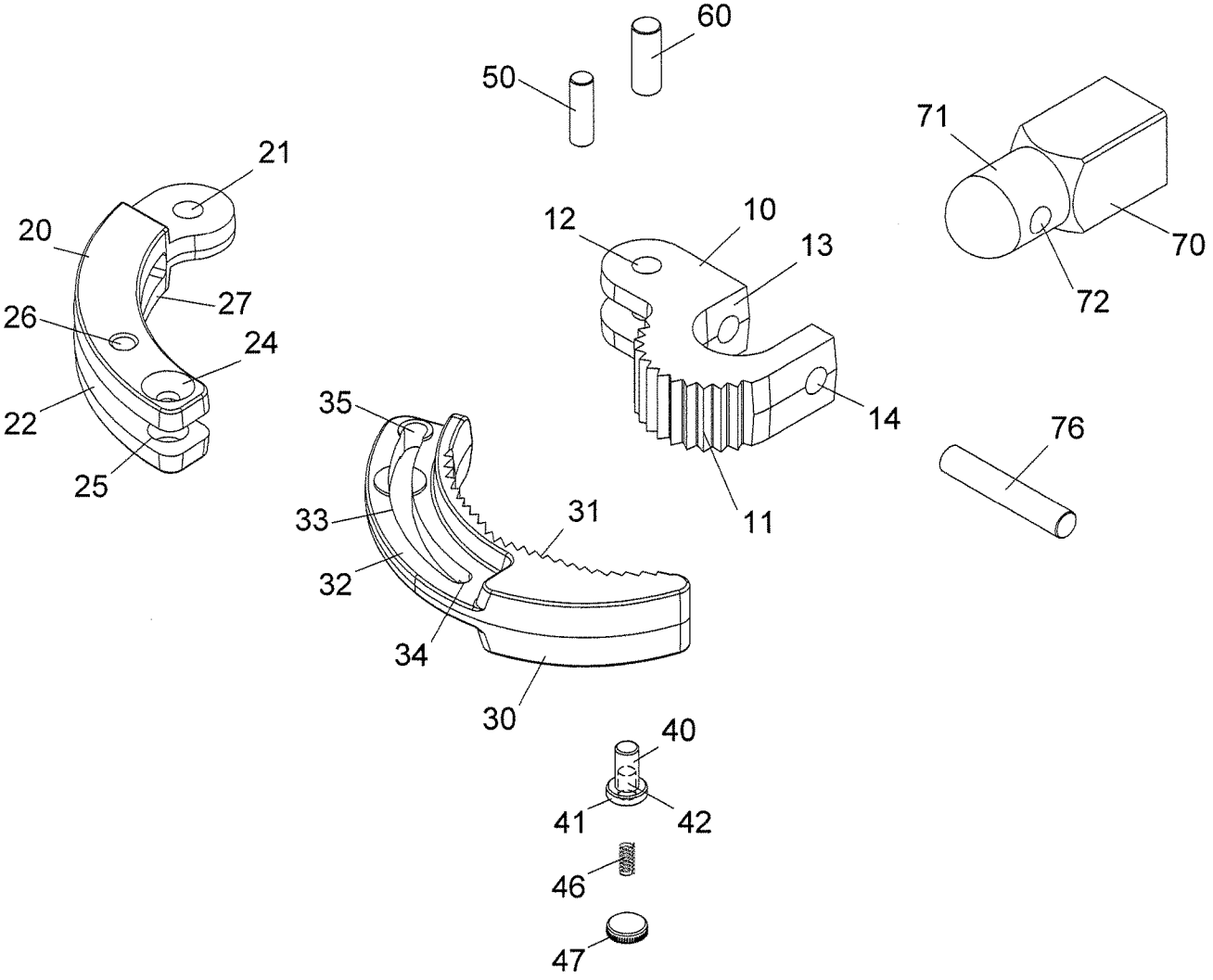
FIG. 1 is an exploded view of the wrench of the present invention.
Figure 2:
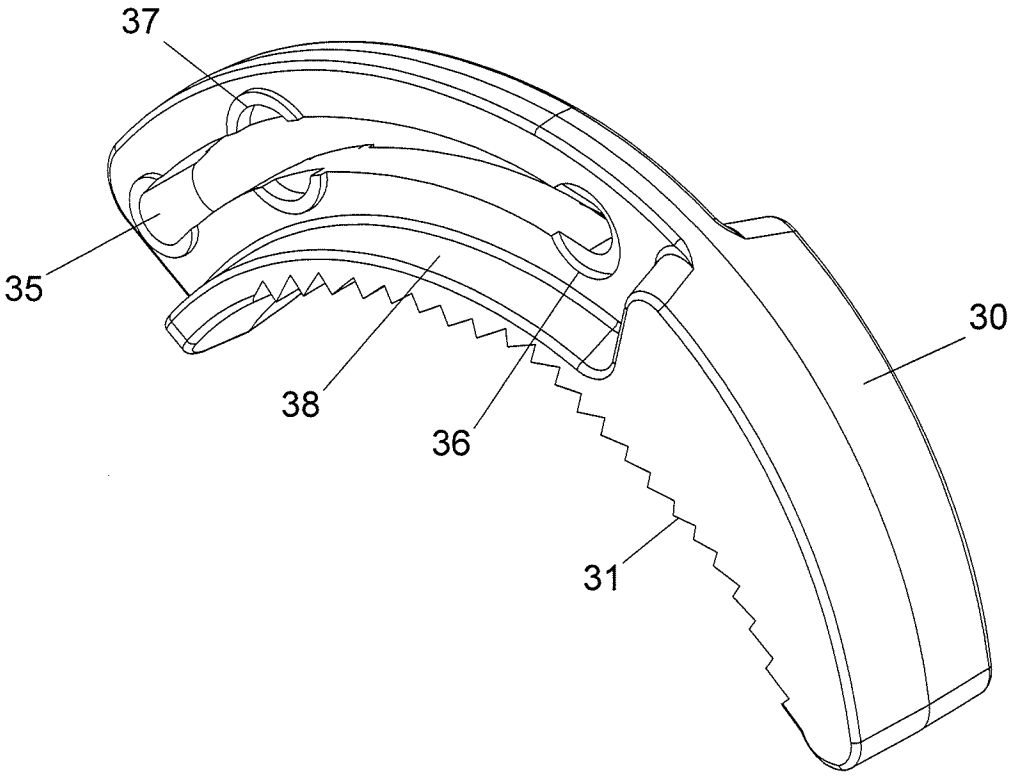
FIG. 2 is a perspective view to show the third part of the wrench of the present invention.
Figure 3:
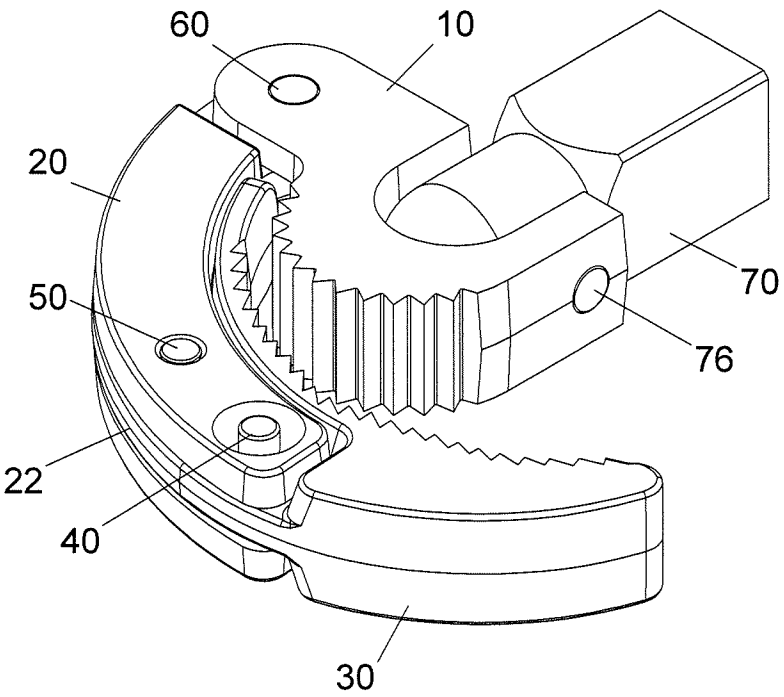
FIG. 3 is a perspective view to show the wrench of the present invention.

Referring to FIGS. 1 and 2, the wrench of the present invention comprises a first part 10 having a first toothed portion 11 defined in a curved and convex surface thereof. A first pivotal portion 12 is a circular hole and formed in the first end of the first part 10. A first room 13 is defined in the opposite side of the tooted portion 11 and located close to the second end of the first part 10. A second pivotal portion 14 is defined in the second end of the first part 10. The first room 13 communicates with the second pivotal portion 14.

A second part 20 is a curved part and has a third pivotal portion 21 and a first passage 24 respectively defined in two ends thereof. The first and third pivotal portions 12, 21 each are a hole, and a first pivot 60 extends through the first and third pivotal portions 12, 21 to pivotably connect the second part 20 to the first part 10. The first pivotal portion 12 is pivotably connected to the third pivotal portion 21 so that the second part 20 is pivotable about the first pivotal portion 12. A second room 22 is defined in the second part 20 and divides the second part 20 to be a fork-shaped part that has a first extension and a second extension, wherein the first passage 24 is defined through the first extension and a first engaging portion 25 is defined through the second extension. The first passage 24 and the first engaging portion 25 both communicate with the second room 22. The first passage 24 is located corresponding to the first engaging portion 25. The second room 22 is located between the first passage 24 and the first engaging portion 25. The diameter of the first engaging portion 25 is larger than that of the first passage 24. A second passage 26 is defined through the first and second extensions and located between the third pivotal portion 21 and the first passage 24. The second part 20 has a curved first face 27 which faces the first part 10.

A curved third part 30 is movably connected to the second part 20 along a curved path so that the third part 30 is overlapped the second part 20 on various areas, such that objects of different sizes can be clamped between the third and second parts 30, 20. The third part 30 is positioned relative to the second part 20 on at least two positions. The third part 30 has a second toothed portion 31 defined in a curved and concaved side thereof and faces the first toothed portion 11. The second toothed portion 31 and the first toothed portion 11 clamp an object therebetween. The third part 30 has an insertion portion 32 which is located within the second room 22, and the height of the second room 22 is smaller than the thickness of the third part 30 except for the insertion portion 32. The insertion portion 32 has a curved slot 33 which has a first inner end 34 and a second inner end 35. The curved slot 33 has a second engaging portion 36 and at least one third engaging portion 37. The diameter of each of the second engaging portion 36 and the at least one third engaging portion 37 is the same as the diameter of the first engaging portion 25. The second engaging portion 36 is located corresponding to the first inner end 34. The at least one third engaging portion 37 is located between the first and second inner ends 34, 35. A second face 38 is defined between the insertion portion 32 and the third part 30. The second face 38 faces the first face 27. A cross sectional area between the insertion portion 32 and the second face 38 is a T-shaped area. The second face 38 is a curved face. The curvature of the third part 30 is matched with the curvature of the second part 20.

An engaging member 40 extends through the first passage 24 and has a fourth engaging portion 41 and a recess 42. The fourth engaging portion 41 is engaged with the second engaging portion 36 and the first engaging portion 25 so that the third part 30 is positioned relative to the second part 20 at a first position by the engaging member 40. The second room 22 and the curved slot 33 are hidden in the second part 20. When pressing and moving the engaging member 40 to disengage the fourth engaging portion 41 from the third engaging portion 37, and to be located in the second engaging portion 36, the third part 30 is movable relative to the second part 20 and along the curved slot 33. When the fourth engaging portion 41 is engaged with the third engaging portion 37 and the first engaging portion 25, the third part 30 is positioned relative to the second part 20 at a second position. The second room 22 and the curved slot 33 partially protruded beyond the second part 20. The engaging member 40 has a recess 42 defined therein.

A spring 46 is received in the recess 42 of the engaging member 40 so that the engaging member 40 returns to its initial position after being pushed. An end piece 47 is fixed to the inner periphery of the first engaging portion 25. Specifically, the end piece 47 is a disk whose outer periphery is snugly in contact with the inner periphery of the first engaging portion 25. The spring 46 is biased between the engaging member 40 and the end piece 47.

A restriction member 50 is a cylindrical member and extends through the second passage 26 and the curved slot 33. The third part 30 is movable along the curved slot 33 and adjusted relative to the second part 20 by the engaging member 40 and the restriction member 50. The restriction member 50 prevents the third part 30 from disengaging from the second part 20, and restricts the maximum displacement of the third part 30. When the fourth engaging portion 41 is restricted by the third engaging portion 37 and the first engaging portion 25, the third part 30 is positioned relative to the second part 20 at the second position, and the restriction member 50 contacts the second inner end 35 of the curved slot 33.

A fourth part 70 is a cylindrical part and includes a head 71 which is located in the first room 13. A fourth pivotal portion 72 is defined in the head 71 and pivotably connected to the second pivotal portion 14 so that the first part 10 is pivotable relative to the fourth part 70 an angle about the second pivotal portion 14. A second pivot 76 extends through the first and fourth pivotal portions 12, 72 to pivotably connect the fourth part 70 to the first part 10.

Figure 7:
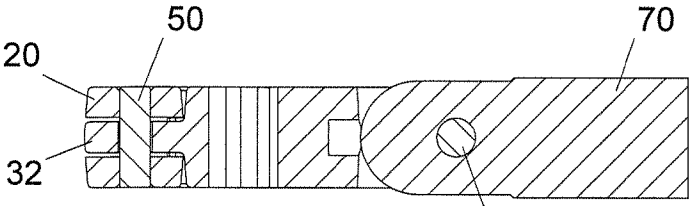
FIG. 7 is a cross sectional view, taken along line 7-7 of FIG. 4.
Figure 6:
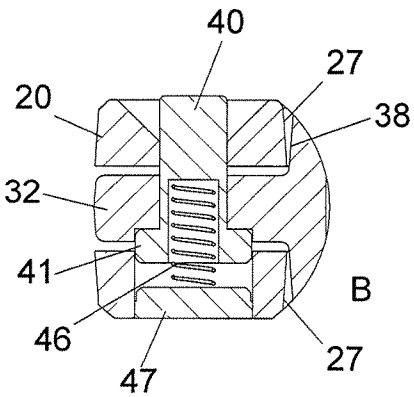
FIG. 6 is an enlarged view of the circled "B" in FIG. 5.
Figure 5:
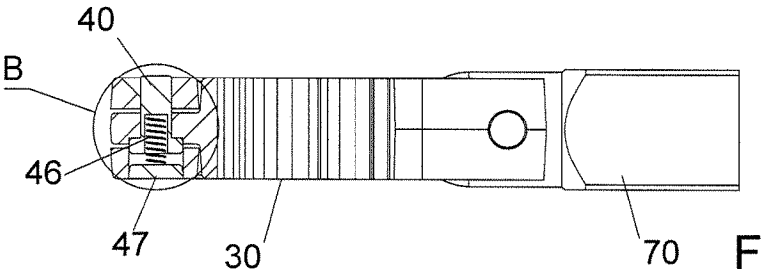
FIG. 5 is a cross sectional view, taken along line 5-5 of FIG. 4.

As shown in FIGS. 4 to 7, the fourth engaging member 41 is engaged with the first and second engaging portions 25, 36 so that the third part 30 is positioned the first position relative to the second part 20 by the engaging member 40. The spring 46 is biased between the engaging member 40 and the end piece 47, as shown in FIG. 7, the restriction member 50 is received in the second passage 26 and the curved slot 33.

Figure 8:
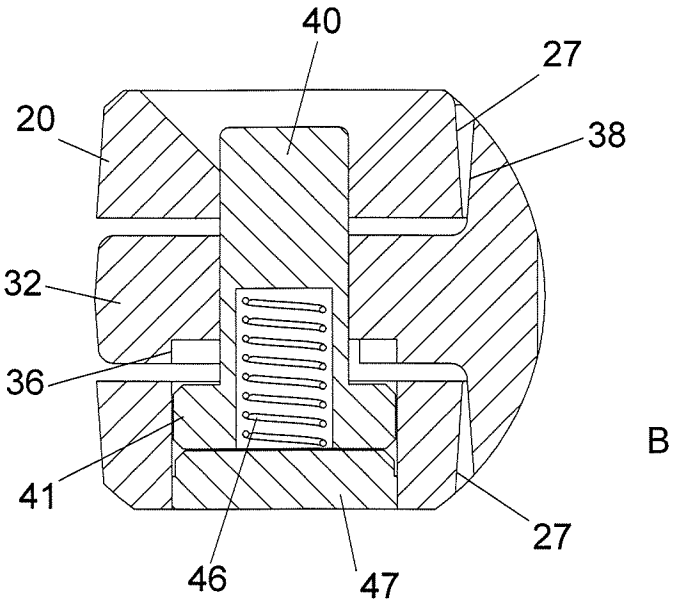
FIG. 8 is a cross sectional view to show the status when the engaging member is pushed.

As shown in FIG. 8, when the engaging member 40 is pushed, the spring 46 is compressed so that the fourth engaging portion 41 is disengaged from the third engaging portion 37 and received in the second engaging portion 36. The third part 30 is movable along the curved slot 33 and movable relative to the second part 20. The engaging member 40 and the restriction member 50 are movable in the curved slot 33.

Figure 9:
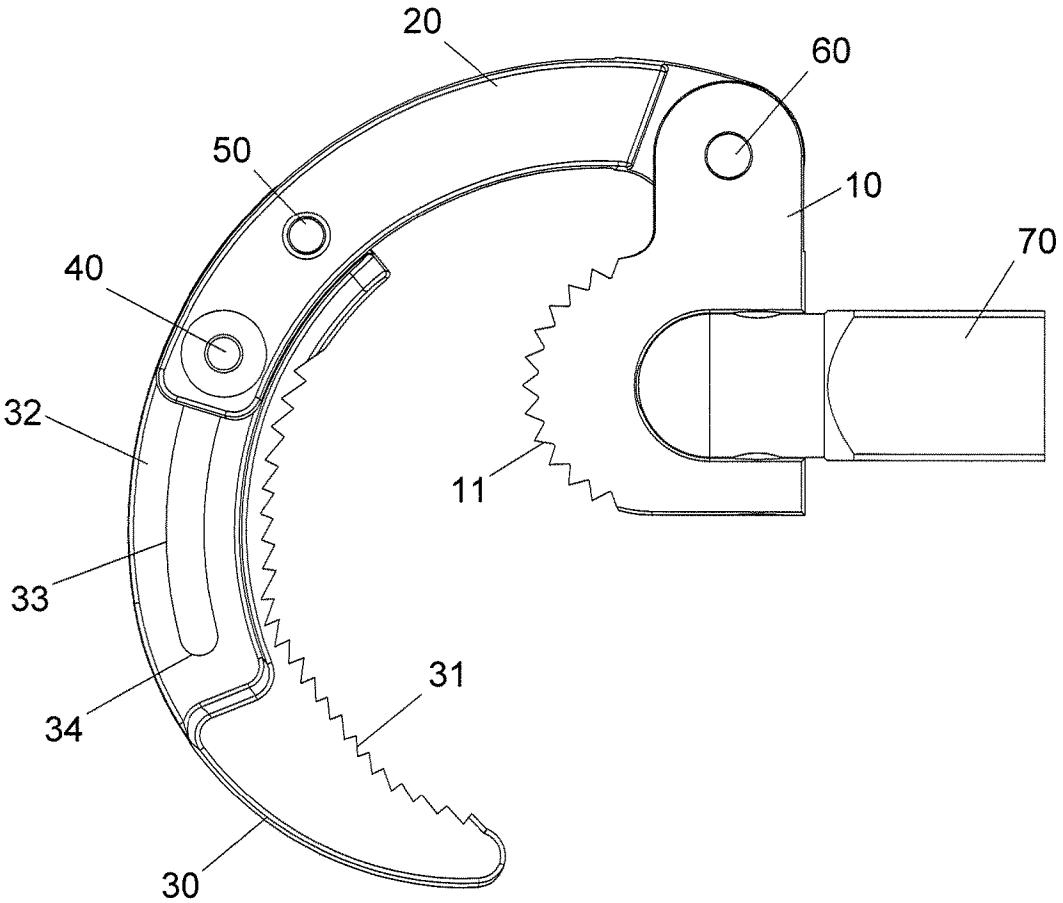
FIG. 9 is a top view to show that the third pat is located at the second position.
Figure 10:
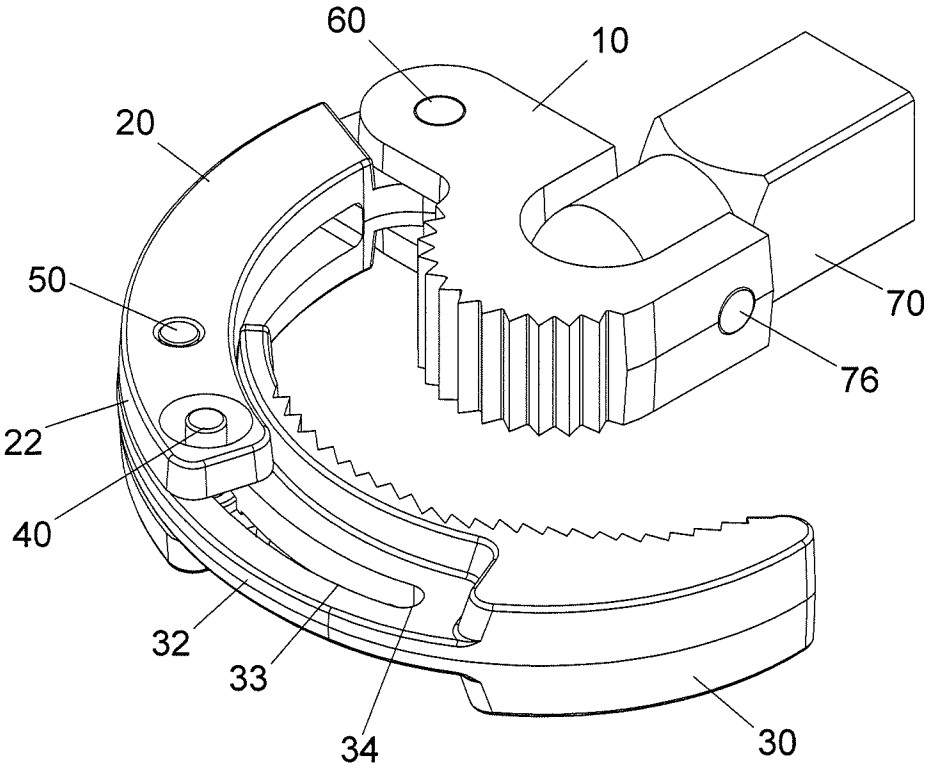
FIG. 10 is a perspective view to show that the third pat is located at the second position.

As shown in FIGS. 9 and 10, when the fourth engaging member 41 is engaged with the first and third engaging portions 25, 37 so that the third part 30 is positioned the second position relative to the second part 20. The insertion portion 32 and the curved slot 33 are partially exposed beyond the second part 20, and the restriction member 50 contacts the second inner end 35 of the curved slot 33. The second part 20 is pivoted about the first pivotal portion 12 to allow the objects such as tubes of nuts of different sizes to be clamped between the first and third parts 10, 30.

Figure 11:
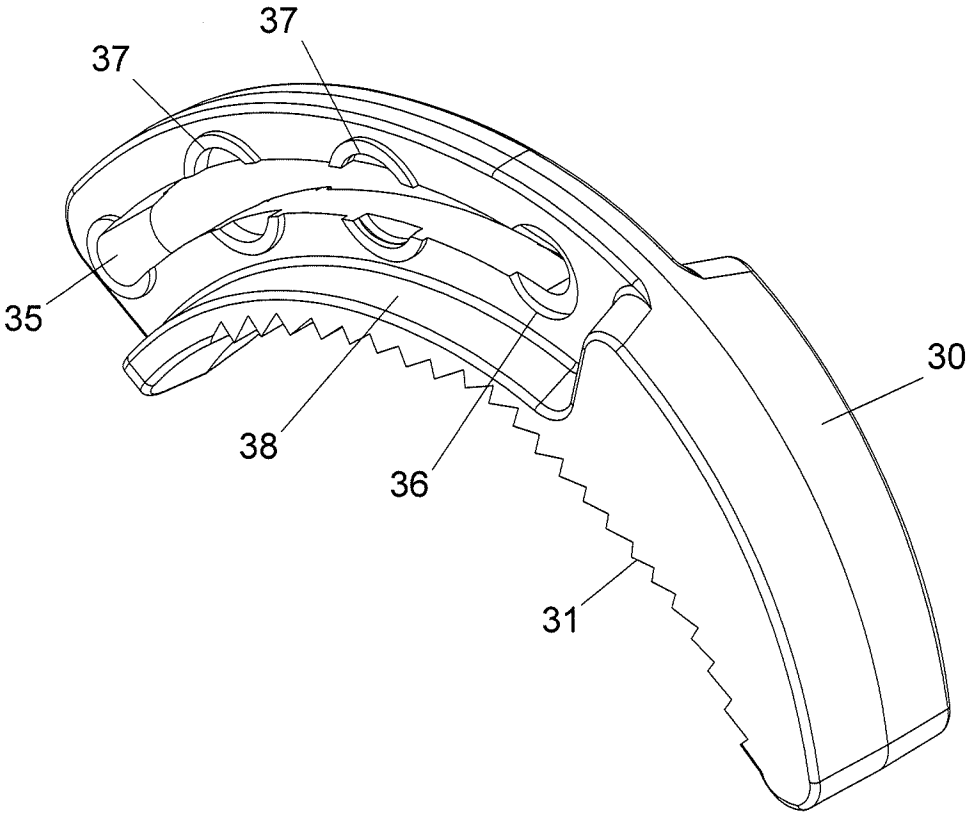
FIG. 11 is a perspective view to show the third part of the second embodiment of the wrench of the present invention.

As shown in FIG. 11, the third part 30 has at least two third engaging portions 37, in other words, the third part 30 is positioned on at least three positions relative to the second part 20 by the at least two third engaging portions 37. Similarly, the third part 30 may have multiple third engaging portions 37, for example four third engaging portions 37, the third part 30 is able to be positioned on five positions relative to the second part 20.

In another embodiment, a coil spring is mounted to the first pivot 60 and biased between the first part 10 and the second part 20 so that the first pivotal portion 12 is resiliently and pivotably connected to the third pivotal portion 21. The coil spring also makes the first toothed portion 11 and the second toothed portion 31 to be located close to each other when the wrench is not in use.

Figure 4:
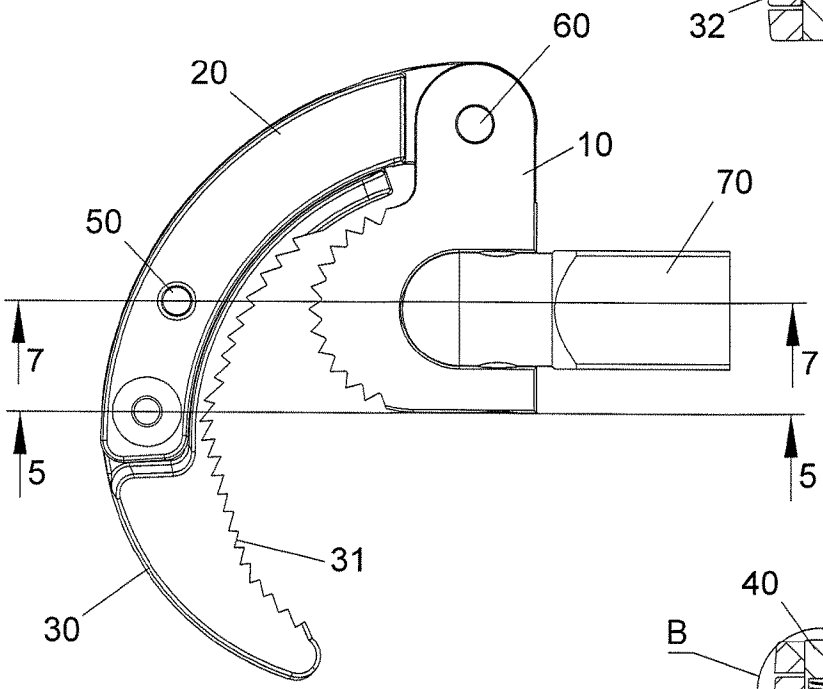
FIG. 4 is a top view of the wrench of the present invention.

In yet another embodiment, the first engaging portion 25 has inner threads and the end piece 47 has outer threads which are engaged with the inner threads of the first engaging portion 25 to connect the end piece 47 to the first engaging portion 25. The advantages of the present invention are that the third part 30 is movably connected to the second part 20 as shown in FIGS. 4 and 9, so that objects of different sizes to be clamped between the first and third parts 10, 30.

The second part 20 has a third pivotal portion 21 which is pivotably connected to the first pivotal portion 12, so that the second part 20 is pivoted about the first pivotal portion 12 and relative to the first part 10. The third part 30 is movable along the second part 20, the second and third parts 20, 30 are pivotable about the first pivotal portion 12. The pivotal path and the curve path are two independent paths.

The fourth engaging member 41 is engaged with the first and second engaging portions 25, 36 so that the third part 30 is positioned the first position relative to the second part 20 by the engaging member 40. The engaging member 40 is pushed to disengage the fourth engaging portion 41 from the third engaging portion 36 and received in the second engaging portion 25. The third part 30 is adjusted relative to the second part 20 along the curved slot 33. When the fourth engaging portion 41 is engaged with the first and third engaging portions 25, 37, the third part 30 is positioned at the second position relative to the second part 20.

The restriction member 50 extends through the second passage 26 and the curved slot 33. The curved slot 33 is tangent to the restriction member 50. By the engaging member 40 the restriction member 50, the third part 30 is movable along the curved slot 33 and adjusted relative to the second part 20. The restriction member 50 prevents the third part 30 from disengaging from the second part 20, and restricts the maximum displacement of the third part 30.

The restriction member 50 is biased by the spring 46 so that when the restriction member 50 is released, the restriction member 50 returns to its initial position. The users operate the restriction member 50 conveniently.

As shown In FIGS. 4 and 9, objects of different sizes to be clamped between the first and third parts 10, 30. When the third part 30 rotates the object, the force from the third part 30 is in Y-axis direction, and the pressing force to the engaging member 40 is in Z-axis direction which is perpendicular to the Y-axis direction, so that the engaging member 40 does not shift when rotating the third part 30, and this is safe for the users.

While we have shown and described the embodiment in accordance with the present invention, it should be clear to those skilled in the art that further embodiments may be made without departing from the scope of the present invention.

What is claimed is:

1. A wrench comprising:

a first part having a first toothed portion defined in a curved and convex surface thereof, a first pivotal portion formed in a first end of the first part, a first room defined in an opposite side of the tooted portion and located close to a second end of the first part, a second pivotal portion defined in the second end of the first part, the first room communicating with the second pivotal portion;

a second part being a curved part and having a third pivotal portion and a first passage defined in two ends thereof respectively, a second room defined in the second part and dividing the second part to be a fork-shaped part having a first extension and a second extension, the first passage being through the first extension and a first engaging portion defined through the second extension, the first passage and the first engaging portion both communicating with the second room, the first passage located corresponding to the first engaging portion, the second room located between the first passage and the first engaging portion, a diameter of the first engaging portion being larger than that of the first passage, the first pivotal portion being pivotably connected to the third pivotal portion so that the second part is pivotable about the first pivotal portion, a second passage defined through the first and second extensions, the second passage located between the third pivotal portion and the first passage, the second part having a curved first face which faces the first part;

a curved third part movably connected to the second part so that the third part is overlapped the second part on an area, the third part being positioned relative to the second part on at least two positions, the third part having a second toothed portion defined in an concaved side thereof and facing the first toothed portion, the second toothed portion and the first toothed portion adapted to clamp objects of different sizes therebetween, the third part having an insertion portion which is located within the second room, a height of the second room being smaller than a thickness of the third part except for the insertion portion, the insertion portion having a curved slot which has a first inner end and a second inner end, the curved slot having a second engaging portion and at least one third engaging portion, a diameter of each of the second engaging portion and the at least one third engaging portion being the same as the diameter of the first engaging portion, the second engaging portion located corresponding to the first inner end, the at least one third engaging portion located between the first and second inner ends, a second face defined between the insertion portion and the third part, the second face facing the first face, a cross sectional area between the insertion portion and the second face being a T-shaped area, the second face being a curved face;

an engaging member extending through the first passage and having a fourth engaging portion and a recess, the fourth engaging portion engaged with the second engaging portion and the first engaging portion so that the third part is positioned relative to the second part at a first position by the engaging member, the second room and the curved slot being partially within the second part, when pressing and moving the engaging member to disengage the fourth engaging portion from the third engaging portion and to be located in the second engaging portion, the third part is movable relative to the second part and along the curved slot, when the fourth engaging portion is engaged with the third engaging portion and the first engaging portion, the third part is positioned relative to the second part at a second position, the second room and the curved slot partially protruded beyond the second part, the engaging member having a recess defined therein;

a spring received in the recess of the engaging member so that the engaging member returns to its initial position after being pushed;

an end piece fixed to an inner periphery of the first engaging portion, the spring being biased between the engaging member and the end piece;

a restriction member being a cylindrical member and extending through the second passage and the curved slot, the curved slot being tangent to the restriction member, the third part being movable along the curved slot and being adjusted relative to the second part by the engaging member and the restriction member, the restriction member preventing the third part from disengaging from the second part, and restricting a displacement of the third part, when the fourth engaging portion is restricted by the third engaging portion and the first engaging portion, the third part is positioned relative to the second part at the second position, the restriction member contacting the second inner end of the curved slot, and a fourth part being a cylindrical part and having a head which is located in the first room, a fourth pivotal portion defined in the head and pivotably connected to the second pivotal portion so that the first part is pivotable relative to the fourth part an angle about the second pivotal portion.

2. The wrench as claimed in claim 1, wherein the first and third pivotal portions each are a hole, a first pivot extends through the first and third pivotal portions to pivotably connect the second part to the first part.

3. The wrench as claimed in claim 1, wherein the end piece is a disk whose outer periphery is snugly in contact with the inner periphery of the first engaging portion.

4. The wrench as claimed in claim 1, wherein a second pivot extends through the first and fourth pivotal portions to pivotably connect the fourth part to the first part.

5. The wrench as claimed in claim 1, wherein the third part has at least two third engaging portions, the third part is positioned on at least three positions relative to the second part by the at least two third engaging portions.

6. The wrench as claimed in claim 1, wherein the first and third pivotal portions each are a hole, a first pivot extends through the first and third pivotal portions to pivotably connect the second part to the first part, a coil spring is mounted to the first pivot and biased between the first part and the second part so that the first pivotal portion is resiliently and pivotably connected to the third pivotal portion.

7. The wrench as claimed in claim 1, wherein the first engaging portion has inner threads and the end piece has outer threads which are engaged with the inner threads of the first engaging portion to connect the end piece to the first engaging portion.

* * * * *